US005807159A

United States Patent [19]

Watkins

[11] Patent Number: 5,807,159

[45] **Date of Patent: *Sep. 15, 1998**

[54] STREAMERS AND METHOD OF MAKING THEREFOR

[76] Inventor: James O. Watkins, 14920 Mt. Nebo Rd., Poolesville, Md. 20837

[ * ] Notice: The term of this patent shall not extend beyond the expiration date of Pat. No. 5,620,354.

[21] Appl. No.: 547,015

[22] Filed: Oct. 23, 1995

Related U.S. Application Data

[63] Continuation-in-part of Ser. No. 496,075, Jun. 28, 1995, Pat. No. 5,620,354.

[51] Int. Cl.[6] ..... A63H 37/00

[52] U.S. Cl. ..... 446/475; 83/924; 493/967

[58] Field of Search ..... 446/475; 83/949, 83/924, 29, 14; 493/288, 462, 967, 968, 954; 29/423

[56] References Cited

U.S. PATENT DOCUMENTS

| | | | |
|---|---|---|---|
| 1,090,778 | 3/1914 | Clark | 446/475 |
| 1,664,401 | 4/1928 | Craig | 446/475 |
| 3,648,350 | 3/1972 | Cassidy et al. | 29/423 |
| 5,271,137 | 12/1993 | Schutz | 83/924 X |
| 5,354,227 | 10/1994 | Watkins | 446/475 |
| 5,419,731 | 5/1995 | Watkins | 446/475 |
| 5,620,354 | 4/1997 | Watkins | 446/475 |

FOREIGN PATENT DOCUMENTS

| | | | |
|---|---|---|---|
| 360280 | 4/1906 | France | 446/475 |
| 583242 | 1/1925 | France | 446/475 |

*Primary Examiner*—Mickey Yu
*Attorney, Agent, or Firm*—Ronald B. Sherer

[57] ABSTRACT

A streamer is disclosed which includes at least one strip of plastic film having a silvered layer and a lacquered coating containing a lubricant. In one embodiment, the strip includes a plurality of individual strips wound together with overlapping ends such that the individual strips separate into multiple pieces as the streamer flies through the air. In another embodiment, a lubricant is disposed between each wound layer of film such that the outermost layer may be slid off the streamer without the provision of a tab.

20 Claims, 2 Drawing Sheets

STREAMERS AND METHOD OF MAKING THEREFOR

This application is a continuation-in-part of application Ser. No. 08/496,075 filed 28 Jun. 1995, now U.S. Pat. No 5,620,354, patented on Apr. 15, 1997, the complete disclosure of which is hereby incorporated by reference.

FIELD OF THE INVENTION

The present invention relates to streamers, and more particularly, to streamers composed of metalized plastic film and lacquer coatings whereby the flight characteristics are substantially improved, and to a streamer which may be unsealed by a simple, quick pinching of the fingers.

BACKGROUND

Streamers comprising rolls of paper or tissue paper strips have long been popular amusement devices at conventions, celebrations, and sporting events where the participants throw the streamers and they fly through the air in the form of comets with long tails which progressively unwind from the rolls. Suggestions have been made to manufacture such streamers from Mylar brand plastic film. However, such film poses a fire hazard in crowds because it is flammable, and it also poses a risk of injury in that such film has a relatively high tensile strength which can trip a person if entwined about the feet, or even choke a person if entwined about the neck. In addition, streamers composed of Mylar film are extremely difficult to cut without forming jagged or fused edges which prevent the streamer from unrolling smoothly and/or completely in the air. It will be apparent that partially unrolled streamers flying through the air are hazardous in that they may cause injury if they strike a person, and even aside from possible injury, a streamer which is only partially unrolled is akin to a dud in that it totally fails to achieve the visual effect of a long, comet-like tail flying through the air.

SUMMARY

The present invention provides a streamer which unrolls very smoothly and rapidly in the air, and which unrolls completely so that the full visual effect of a comet, or several comets, with long, shiny tails is achieved. In addition, in one preferred embodiment, the present invention provides a streamer which breaks into multiple tail pieces as it flies through the air, thereby substantially increasing the visual impact of the aerial display of color and motion. In a further embodiment, the streamer is formed without a tab, and the streamer is opened by a simple squeezing or pinching action of the fingers, thereby eliminating the time-consuming and sometimes difficult step of removing a tab in order to unseal the end of the streamer.

These and other objects and advantages will become apparent from the following description of several preferred embodiments of the invention as illustrated in the following drawings.

DETAILED DESCRIPTION

Figure 1:
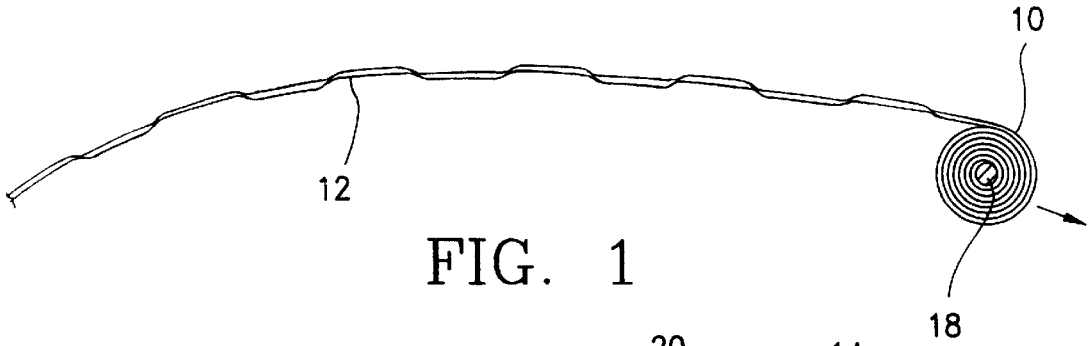
FIG. 1 is a simplified perspective view of a streamer of the present invention flying through the air as the tail unwinds fully in a long serpentine manner.

The first embodiment of the streamer of the present invention will be described with reference to FIG. 1 wherein numeral 10 designates the manufactured streamer flying through the air with an unwinding tail 12. This streamer preferably comprises a roll of metalized PVC film, as opposed to other plastic films; PVC film being flameproof and having other important advantages as will become apparent hereinafter. While a standard film thickness of 1.4 mils may be used, it has been discovered that markedly superior results are obtained with a film thickness in the order of 0.8 mils, and that the use of a high-slip coating, such as Sun-Slip brand coating, substantially improves the unwinding action of the streamer as it flies through the air; Sun-Slip being a trademark for an acrylic lacquer containing silicone as a lubricant.

It has also been discovered that the size of the streamer, in terms of its width and diameter, and the type of coatings, are extremely important factors in the overall performance. For example, it has been discovered that the width of the streamer has a substantial effect on the ability of the streamer to unroll rapidly, smoothly and completely. More specifically, it has been discovered that the width of the streamer should be in the order of 0.15 to 0.6 inches with a preferred width in the order of 0.25 to 0.5 inches. Also, with the PVC film being in the order of 0.15 to 0.6 inches wide and only 0.8 mils thick, it has been discovered that the film breaks very easily such that the spent film does not pose a risk of tripping or choking a person before it is easily picked up and safely disposed.

With respect to the various layers and coatings on the PVC film, prior to the present invention, such film was prepared in one of two forms. In the first form, the film was first metalized with a silver coating on one side, and then a color layer was applied over the silver layer. As a result, the colored side appears as a bright, metallic color, while the silver layer shines through the clear film so that the uncoated side appears to be a shiny, silver color. Thereafter, if any lacquer coating was performed at all, the prior practice was to coat only the colored side of the film. In the second form of such prior art films, the same procedure was followed; however, when it was desired that both sides of the film be colored; ie, instead of having one side appear to be silver, then a layer of color was applied to the non-silvered side of the film, and both of the colored sides were coated with a lacquer including a lubricant. In brief, it was previously believed that the colored layer should be lacquered, and that it made no difference as to whether one or both sides were colored so long as they were lacquered with a lubricant. However, streamers made from PVC films coated in the above manner have continued to stick together and not unroll smoothly or with sufficient rapidity to completely unwind in the air.

It has now been discovered unexpectedly that, for reasons not fully understood, both sides of the PVC film should not be colored, and that even with only one side colored, both sides of the film should be coated with a lacquer/lubricant such as an acrylic lacquer containing silicone. That is, for streamers to have optimum flight characteristics in terms of unwinding smoothly, rapidly and completely during every flight, the clear PVC film should first be metalized with a silver coating, and if a color other than silver is desired, the color layer should be applied only to the metalized side; ie, leaving the other, second side of the clear film uncoated with the silver coating shining through. Thereafter, a lacquer including a lubricant such as silicone should be applied to both sides. That is, the lubricant layer should be applied over the color layer if it the film colored, or over the uncolored metalized side if it is not colored, and the lubricant layer should also be applied over the second, uncoated side of the film. When films are prepared in this manner, with one side silvered, and only that side colored, if color is desired, and both sides lacquered with lubricant, substantial tests have proven the above-indicated flight characteristics to be achieved in a completely consistent and reliable manner. These tests have also discovered that, while the second side of the film should not be colored, as stated above, a black coating containing a high percentage of carbon is not only the exception, but such a black layer actually acts to further promote the ability of the streamer to unroll rapidly and completely. The reason is not fully understood, and the reason forms no part of the present invention, but it is believed that the non-conductive carbon particles in the black layer may inhibit the formation of static electricity between the layers of the streamer as the film is rapidly wound to form the streamer. Therefore, while it has been discovered that the second side of the film (ie, the not silvered side) should not be colored with any color of the rainbow, it has been discovered that such second side of the film may be colored with a black layer of high carbon content, and that such a black layer actually promotes the smooth, rapid and complete winding action of the streamer.

With respect to the diameter, it has been found that a streamer for hand throwing should preferably have a length in the order of 8 to 30 feet such that, for a streamer composed of metalized PVC film having a thickness in the order of 0.8 mils, the preferred diameter of the streamer should be in the order of 0.5 to 1.5 inches, and more preferably in the order of 0.6 to 0.9 inches.

Figure 2:
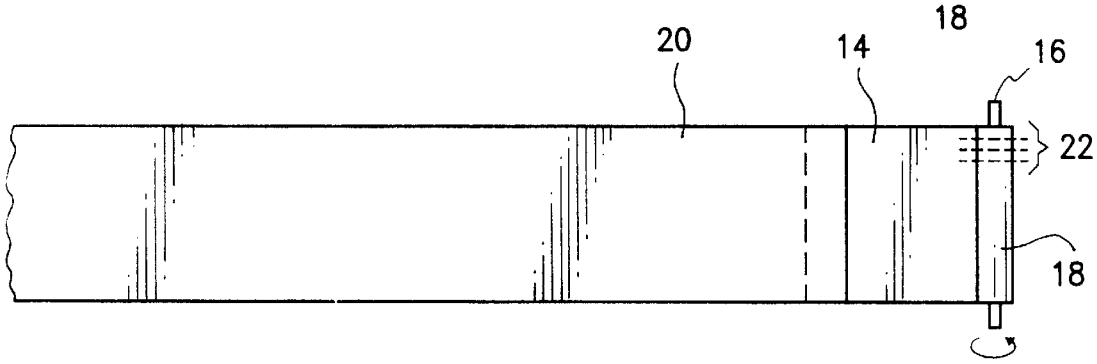
FIG. 2 is a schematic top view of one preferred method of manufacture of the streamer of the FIG. 1 embodiment.

One preferred method of manufacture of the FIG. 1 embodiment will now be described with reference to FIG. 2. One or more sheets of tissue paper 14 are first wound about a removable winding stick 16 to form a soft core 18 of tissue paper. For example, the tissue paper may be wrapped about the stick such that 2–60 inches, and preferably 8–30 inches, of tissue paper comprise the core. At the trailing edge of tissue paper 14, the leading edge of the metalized PVC film 20 is secured such as by pieces of adhesive tape (not shown), or merely by overlapping the film over the tissue paper, as shown, and winding the overlapped layers into the roll.

Once the full length of the plastic film 20 has been wound about tissue paper core 18, the winding stick 16 is removed by pulling it out from the center of the tissue paper core, and the trailing edge of the plastic film is taped to the completed roll, or "log" as it is called. The completed roll or log is then placed in a cutting machine and is cut transversely to the longitudinal axis of the log, as illustrated by cut lines 22, so as to produce individual streamers having the small widths as previously described. Because of the soft, tissue paper core 18, the plastic film may be cut cleanly without creating jagged or fused edges such that the entire length of even a 30 foot streamer unwinds rapidly, smoothly and completely as it flies through the air. In addition, the unique coatings of the PVC film as previously described further ensure that the separation of all layers are smooth and not impeded by the tendency of the tight, spiral wound, contact of the layers to set and stick together, particularly during long periods of storage before use. The result is a long flowing, twisting, and completely unwinding tail 12 which leaves only a tiny tissue paper core which presents no hazard at the end of the flight of the streamer.

Figure 3:
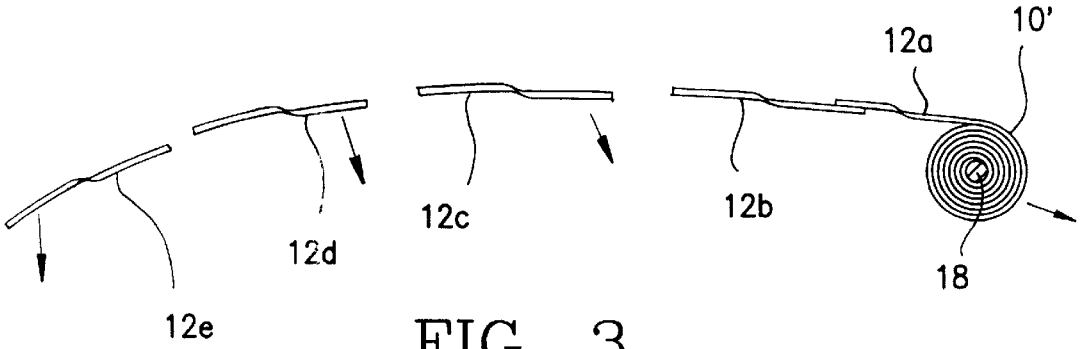
FIG. 3 is a simplified perspective view of a second embodiment of the streamer of the present invention wherein the tail separates into multiple pieces as it flies through the air.
Figure 4:
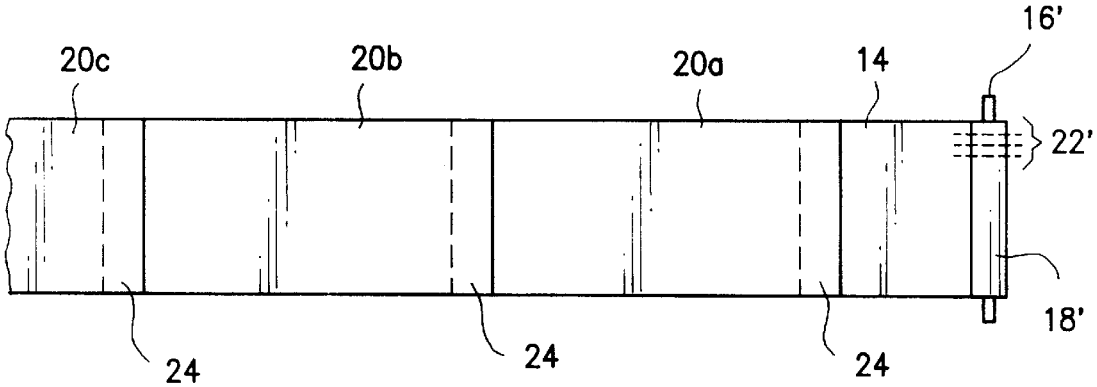
FIG. 4 is a simplified top view showing one preferred method of manufacture of the streamer of the FIG. 3 embodiment.

Referring to FIGS. 3 and 4, a second embodiment of the invention is shown wherein numeral 10' represents the streamer, and numerals 12*a, b, c, d* and *e* represent a multi-piece tail wherein the plurality of pieces separate from the streamer and from each other as the streamer flies through the air. This provides multiple objects to the eye, instead of only one tail, and this produces a much more dramatic and dynamic effect to the eye of the observer. The materials, dimensions, and method of manufacture of this embodiment are the same as those previously explained, except that, instead of the PVC film 20 being one long, continuous piece, separate overlapping pieces 20*a,* 20*b,* 20*c,* etc. are wound into the roll as shown in FIG. 4. Alternatively, pieces 12*a*–12*e* may be of different compositions such as alternate pieces may be composed of PVC film and alternate pieces may be composed of tissue paper. Preferably, the amount of overlap 24 between the ends of the pieces is in the order of 1 to 4 inches or, more preferably, 2 to 3 inches since it has been discovered that this amount of overlap is sufficient to pull the next piece off the streamer and still separate therefrom quickly to form a large plurality of separate, twisting and turning pieces falling individually through the air. It has also been discovered that the number of pieces should be in the order of 10 to 50, with the length of each of the pieces being in the order of 8 to 20 inches, and preferably in the order of 10 to 15 inches in order to achieve the optimum action of pulling the next piece off the streamer and quickly separating to form the multi-piece display.

Figure 5:
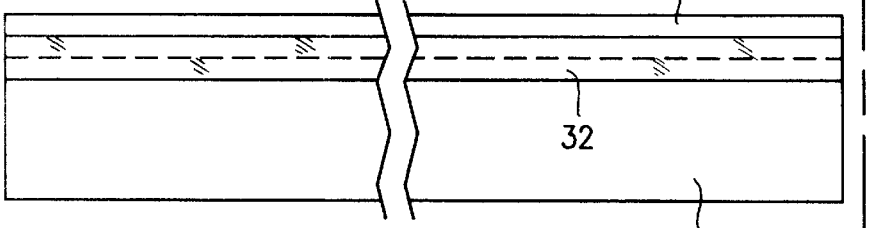
PRIOR ART FIG. 5
FIG. 5 is a side elevational view of a wound roll or log showing a conventional tab of the Prior Art before cutting the log into individual streamers.
Figure 6:
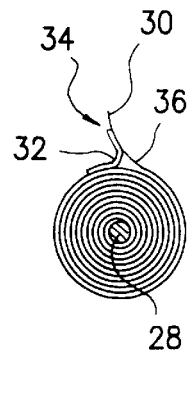
PRIOR ART FIG. 6
FIG. 6 is an end view of the wound log taken along the view line 6—6 of FIG. 5.

Referring now to FIGS. 5 and 6, a conventional wound roll or log 26 of the prior art is shown after it has been wound with tissue paper or plastic film about a solid or soft core 28. In the past, in order to secure the loose end 30 of the film or tissue paper during cutting of the log into the individual streamers, and to secure the individual streamers prior to use, it has been necessary to tape the loose end with a piece of longitudinally extending tape 32. However, in order to attempt to make the tape as removable as possible prior to launching the streamers, the tape has been applied with one portion of the adhesive side against the roll and the other portion against the underside of loose end 30 thereby forming a tab 34. With streamers made of tissue paper, such tabs work fairly well because, when the tab is pulled, the tissue paper tears easily. However, portions of the tape sometimes become exposed during the tearing such that upon loading the streamer into a cannon, the exposed part of the tape may re-stick to a surface portion of the streamer and thereby prevent the streamer from unwinding either completely or not at all. In the case of streamers made from wound plastic film, such as either Mylar of PVC film, the problem is more sever because such films do not tear easily. Moreover, even if the film is torn, such as by using one's teeth or fingernails, the tear is usually at or about the point indicated by numeral 36. This produces an exposed portion of the adhesive side of tape 32 facing the streamer which tends to re-stick to the surface of the streamer and may severely restrict or completely inhibit the unwinding of the streamer.

Figure 7:
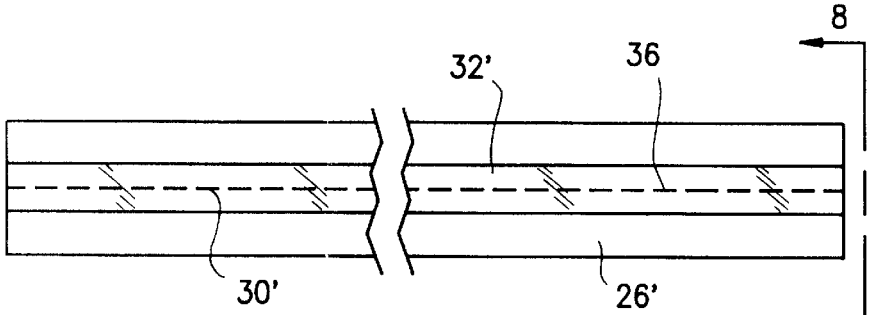
FIG. 7 is a side elevational view of a wound log of the present invention.
Figure 8:
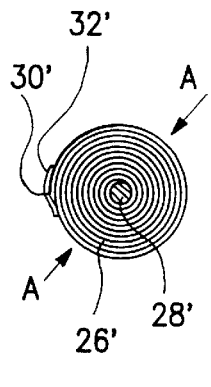
FIG. 8 is an end view of the wound log taken along view line 8—8 of FIG. 7.
Figure 9:
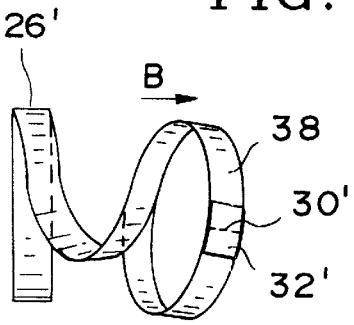
FIG. 9 is a front elevational view of a streamer with the outermost layer separated from the streamer by pinching the outer surface of the streamer.

This serious problem is completely solved by the present invention by eliminating the formation of any tab, and eliminating the requirement to tear any portion of the film in order to create the loose tail which is required prior to use of the streamer. In the present invention, all of end 30' of the film is secured in contact with and tightly against the surface of the roll by a piece of tape 32'. That is, as shown in FIGS. 7–8, the tape covers the entire end 30' including the final edge 36 which would otherwise have become the tab of the prior art. The wound log 26' is then cut by a cutting machine perpendicularly to the longitudinal axis so as to form the plurality of individual streamers as previously described. When it is desired to use the streamers by hand throwing, or when the streamers are to be loaded into a cannon, or when otherwise packaging the streamers as will be more fully described, each streamer is merely pressed, or squeezed, between the fingers as represented by force arrows A—A. Because of the slippery surfaces provided by the lacquer containing the lubricant, this simple squeezing or pinching action causes the outermost layer, or few layers, to slide axially off of the other layers, as represented by arrow B, without removing the tape or tearing the film as schematically illustrated in FIG. 9. In this manner, the outermost layer forms a closed loop 38 which adds to the drag force in the air, and the tape piece 32' remains firmly secured to the outermost loop such that it cannot stick to any other portion of the streamer. Thus, it cannot inhibit the full and smooth unwinding of the streamer in the air. In addition, the pinching action is many times faster than unsealing tabs or tearing the film such that cannons containing many streamers may be loaded much faster than with the prior art tabs.

Figure 10:
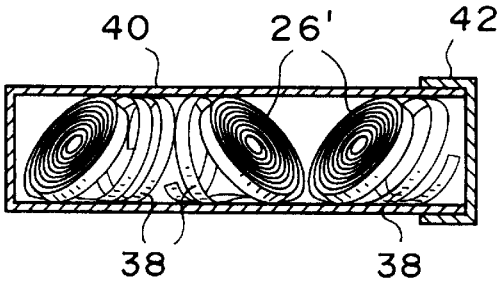
FIG. 10 is a side elevational view, partly in cross-section, showing a container with a plurality of pre-pinched streamers contained therein.

As a further result of the present invention, small pluralities of streamers for hand-throwing simultaneously may be unsealed by the pinching method described above and quickly loaded into small capsules or containers indicated as 40 in FIG. 10. Such containers may comprise a small tube, such as 2–4 inches long, for example, preferably composed of clear plastic, having a diameter in the order of ½ to 1½ inches, and being closed by a removable cap 42. A handful of streamers 26' such as three to ten, for example, may be packaged in the capsule with their bright metallic colors and/or silver sides showing through the clear plastic such as to form a novel and decorative party favor. Upon removing the cap, the handful of streamers is simply poured into the hand, and thrown such that the plurality of streamers fly through the air simultaneously as a very colorful and dynamic aerial display. Of course, it will be apparent that the tabless manufacturing and pinching method of opening the streamers applies to the embodiments of both FIG. 1–2 and FIG. 3–4, and that both of these embodiments may be packaged and used as described with respect to FIG. 10.

It will be apparent from the foregoing description of several illustrative embodiments of the present invention that it solves the serious problem of streamers not unwinding fully, and further provides for multiple pieces of a single streamer such as to make a substantially more dynamic display, and also solves the problem of unsealing streamers prior to use more quickly and without producing exposed sticky portions of tape which may inhibit the unwinding. This also results in the production of multiple streamers which may be simply removed from a container and hand-thrown without the need to unseal each streamer before throwing them as a plurality. It will also be apparent to those skilled in the art of manufacturing streamers that numerous variations are possible based upon the foregoing description of the principles of the invention. Accordingly, it is to be understood that the foregoing description is intended to be purely illustrative of the invention, rather than limiting thereof, and that the invention is not intended to be limited other than as expressly set forth in the following claims interpreted under the doctrine of equivalents.

What is claimed is:

1. A streamer for being launched into the air comprising:

(a) at least one wound strip of PVC film;

(b) said strip of PVC film having a metalized silvered layer on one side;

(c) said strip having lacquered coatings on both sides; and (d) wherein each of said lacquered coatings contain a lubricant.

2. The streamer of claim 1 wherein said lubricant is silicone.

3. The streamer of claim 1 wherein said film has one color layer, said color layer being over said metalized silver layer.

4. The streamer of claim 3 wherein said film has a second color layer, said second color layer being a black coating of high carbon content on the non-silvered side of said strip.

5. The streamer of claim 1 wherein the width of said film is in the order of 0.15 to 0.6 inches.

6. The streamer of claim 1 wherein said streamer includes a soft core composed of rolled tissue paper whereby the streamer may be cut without forming jagged or fused edges to inhibit the unwinding thereof.

7. The streamer of claim 1 wherein said strip of PVC film comprises a plurality of overlapped strips, and wherein the lengths of said overlapped strips are in the order of 10 to 20 inches.

8. The streamer of claim 7 wherein the amount of the overlap between said plurality of strips is in the order of 1 to 4 inches.

9. The method of forming a plurality of streamers comprising the steps of:

(a) rolling an elongated strip of plastic film having one side silvered and both sides lacquered to form a wound cylindrical log having a loose end at the end of said wound strip;

(b) said cylindrical log with a piece of tape covering said end completely;

(c) cutting said log along a plurality of cut lines extending perpendicular to the longitudinal axis of said log to produce a plurality of streamers of predetermined widths having their ends continued to be completely covered by said tape.

10. The method of claim 9 further including the step of pinching said streamers so as to remove at least their outermost layers containing said tape affixed thereto so as to form loose ends on each of said streamers having no exposed portions of said tape to inhibit unwinding.

11. The method of claim 9 wherein said lacquered sides include a lubricant.

12. The method of claim 11 wherein said lacquered sides include silicone as said lubricant.

13. The method of claim 9 wherein said strip comprises a plurality of separate overlapped strips, and said overlapped strips are rolled to form a spiral of separate overlapped strips which form a tail of separable tail pieces as the streamer flies through the air.

14. A novelty item comprising:

(a) a container having an opening;

(b) a removable cover closing said opening;

(c) a handful of streamers contained in said container;

(d) at least some of said streamers being composed of wound strips of plastic film having soft cores;

(e) said strips of plastic film being composed of PVC film, and one side of said PVC film having a silvered layer;

(f) said streamers composed of PVC film having widths in the order of 0.15 to 0.6 inches; and (g) said streamers having both sides of said film coated with a lacquer coating, and said lacquer coating including a lubricant whereby said handful of streamers in said container may be held in the hand and thrown simultaneously as a plurality of streamers which unwind completely in the air.

15. The novelty item of claim 14 wherein said lubricant comprises silicone.

16. The novelty item of claim 14 where in the outermost layer of each of said streamers composed of PVC film has been removed from its respective streamer before being contained in said container.

17. The novelty item of claim 14 wherein said container comprises a clear plastic tube, said clear plastic tube having a length in the order of 2 to 4 inches, and said handful of streamers comprises in the order of 3 to 10 streamers.

18. A tabless streamer comprising:

(a) a wound strip of plastic film forming said streamer;

(b) said streamer having an outer surface portion;

(c) said wound strip of plastic film having an end portion, said end portion lying against said outer surface of said wound streamer and said end portion having a terminal edge;

(d) a piece of tape lying over said end portion and securing said end portion and terminal edge against said outer surface of said wound streamer; and (e) a coating of lubricant on said wound plastic film, said lubricant coating being disposed between each contacting layer of said wound plastic film such that the outermost layer of plastic film may be slid off said streamer without tearing either said film or said tape.

19. The tabless streamer of claim 18 wherein said lubricant coating comprises a lacquer containing a lubricant, and said lubricant coating is disposed on both sides of said plastic film.

20. The tabless streamer of claim 19 wherein said plastic film comprises PVC film having one side metalized with a silver layer.

* * * * *